US006167345A

United States Patent [19]

Strandberg et al.

[11] Patent Number: 6,167,345

[45] Date of Patent: Dec. 26, 2000

[54] METHOD AND A DEVICE FOR FINALIZING DATA CARRYING COMMUNICATION EQUIPMENT IN TRAFFIC CONTROL SYSTEMS

[75] Inventors: Stefan Strandberg, Jönköping; Carl-Olov Carlsson, Mullsjö, both of Sweden; Andrew Pickford, Cambridge, United Kingdom

[73] Assignee: Combitech Traffic Systems AB, Jonkoping, Sweden

[21] Appl. No.: 09/101,829

[22] PCT Filed: Jan. 16, 1997

[86] PCT No.: PCT/SE97/00061

§ 371 Date: Oct. 21, 1998

§ 102(e) Date: Oct. 21, 1998

[87] PCT Pub. No.: WO97/26624

PCT Pub. Date: Jul. 24, 1997

[30] Foreign Application Priority Data

Jan. 17, 1996 [SE] Sweden ..... 9600191

[51] Int. Cl.[7] ..... G07B 15/00

[52] U.S. Cl. ..... 701/117; 340/928

[58] Field of Search ..... 701/117, 118; 340/902, 904, 905, 928; 235/384; 705/13, 41

[56] References Cited

U.S. PATENT DOCUMENTS

| | | | |
|---|---|---|---|
| 5,144,553 | 9/1992 | Hassett et al. | 705/13 |
| 5,206,643 | 4/1993 | Eckelt | 340/932.2 |
| 5,459,304 | 10/1995 | Eisenmann | 235/380 |
| 5,485,520 | 1/1996 | Chaum et al. | 380/24 |
| 5,554,984 | 9/1996 | Shigenaga et al. | 340/937 |
| 5,710,702 | 1/1998 | Hayashi et al. | 701/1 |
| 5,751,973 | 5/1998 | Hassett | 395/213 |
| 5,974,397 | 10/1999 | Olsson et al. | 705/13 |

FOREIGN PATENT DOCUMENTS

| | | |
|---|---|---|
| 3927236 | 2/1991 | Germany . |
| 4140859 | 6/1993 | Germany . |
| 4339438 | 10/1995 | Germany . |
| WO94/07206 | 9/1993 | WIPO . |

*Primary Examiner*—Tan Nguyen

*Attorney, Agent, or Firm*—Pollock, Vande Sande & Amernick, R.L.L.P.

[57] ABSTRACT

End or concluding production of data carrying communication equipment in traffic checking systems, which comprise a plurality of stationary communication equipments for remotely checking passing vehicles which are provided with mobile data carrying units (23) for remote communication. The data carrying communication equipment of the stationary equipment and the vehicle units are manufactured initially in serial production in non-defined shape without any storing of the data required for the communication. For end production including storing of data a plurality of computers (2) for general data processing and data storage media (1, 16) which are associated therewith and can be individually handled are used. A system administrator (AY) produces a storage medium (3) containing all the data for the communication. Therefrom separate media (15, 18–20) are produced containing those data which are required for storing data in both the respective stationary equipments and in the respective vehicle units, and they are sent to the system operator (AZ) for the stationary equipments and the system distributor (BZ), respectively, which performs storing of data and distribution of the vehicle units.

9 Claims, 1 Drawing Sheet

METHOD AND A DEVICE FOR FINALIZING DATA CARRYING COMMUNICATION EQUIPMENT IN TRAFFIC CONTROL SYSTEMS

FIELD OF THE INVENTION

The present invention relates to a method and device for production of data carrying communication equipment in traffic checking systems, more particularly to end or conclude production of data for adaption to different uses. The invention can in particular be applied to such equipment which is used for checking traffic and for collecting traffic fees.

BACKGROUND OF THE INVENTION

In various traffic situations some form of communication between a vehicle and an installation in a passage place can be required. Such communication can be a check that the vehicle is authorized to pass the checkpoint or a recording that a definite vehicle has passed at a particular time. Another frequent situation for communication involving a vehicle includes that an operation for collecting/recording a fee is performed, where the fee can be a toll fee for passing a particular road section, a bridge or a tunnel or a fee for accessing a parking area. The invention is in particular related to communication for collecting fees.

Such checkpoints exist which are provided with service personnel, a checking guard and a paying station for paying the fee. Also partly automated systems exist in which the vehicle driver possesses some identifying means which can be read in the checkpoint. In an operation for paying the fee it is then common that the driver has a magnetic card which is inserted and read in an automatic device which records the fee on an account in order to charge the owner of the card.

These systems are described as examples require the vehicle to stop in order to make it possible to perform the operation. However, there is a desire to avoid such stops in order to obtain a more flexible traffic flow. Thus, systems have been devised which work using remote sensing of an identifying means carried by the vehicle. Then often transponder methods are used which include that the checkpoint is provided with an active radio transmitter/receiver and that the vehicle is provided with a similar passive device which is arranged to receive the signal carrying codes from the radio equipment of the checkpoint, modulate it in order to carry a response message and retransmit it to the radio equipment of the checkpoint. Such a passive transmitter/receiver is called a transponder and provides as a response signal in its simplest shape only an identification of the vehicle. However, it can be expanded in order to store and process further data in an advanced manner so that also relatively complicated paying operations can be executed. They then include that after an identifying operation it is communicated that the fee can be drawn from an account set up for the purpose or from the balance of electronic money stored in the transponder and also further operational steps can exist. A system of this kind is described in U.S. Pat. No. 4,303,904 to Chasek.

For such operations based on stored data and programs sometimes the transponder is connected to a computer which most advantageously has the shape of a so-called smart card, thus a minicomputer in the shape of a card, which can be inserted in a reader connected to or accommodated in the transponder unit. This arrangement has in particular the advantage that the same transponder can be used for different purposes and by different users of the vehicle, thereby including a selective recording of fees and other data for the respective user.

Such an arrangement will then be physically complicated and has a higher cost than arrangements including only a transponder even if it is provided with a relatively large storage and processing capacity. Therefore, it has appeared that a need exists for an intermediate shape of the transponders that are used today and that do not allow the described selective operation in a secure way. The need also exists to supplement the more complicated shape including the transponder with a separate data carrying unit, such as a smart card.

SUMMARY OF THE INVENTION

The object of the present invention is to provide a method and a device for producing transponders in such a way that they can be provided with selective storing and data processing functions and in particular in the purpose of allowing these operations to be associated with definite users which have own access to the computer of the transponder.

The above objects are accomplished according to the invention by using a separate data system for producing programming means in a hierarchic structure for a final adaption of basic transponder units. Thereby transponders which are similar in their physical construction and can be made in large series, can be adapted for secure use by definite users or for use for different purposes respectively.

BRIEF DESCRIPTION OF THE DRAWINGS

In the following an embodiment of the method and the device respectively for using the transponder are described. The method and the device are then illustrated by the FIGURE on the accompanying drawing.

DETAILED DESCRIPTION OF THE INVENTION

Figure 1:
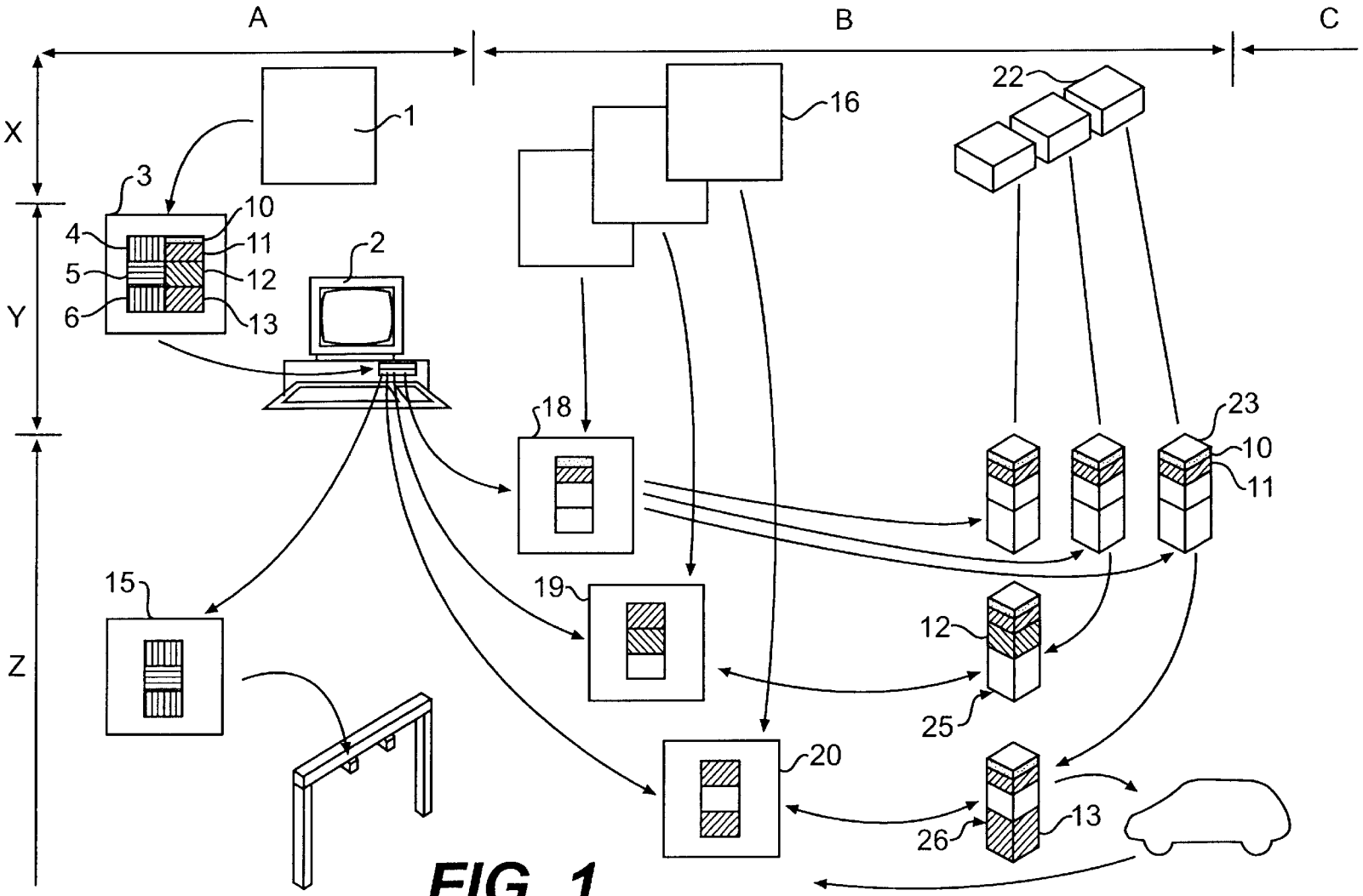

In the FIGURE, different data storage and processing units are illustrated which cooperate to form the system by means of which the method is carried out. The FIGURE is divided in a plurality of vertical fields A, B, C and horizontal fields X, Y, Z. The field X includes the non-defined data media which are used and which thus are to be adapted by means of the method. They are manufactured in their physical shape in large series and are open for storing data. The next field Y indicates the operation of a system administrator. The system administrator processes all data for using the system and is in that way the only person that can supply means for using the system. The next field Z indicates both an operator of the system and one or generally a plurality of distributors of the vehicle equipment which can deliver transponders adapted for each purpose to users. The field then also indicates the work made in this adaption operation.

The FIGURE is also divided in vertical fields A, B, C. The field X, indicating the manufacture of the physical units, then extends through the two fields A and B. However, the field Y, indicating the system administrator, is restricted to the field A and in the field Z in column A the system operator is indicated and in B the system distributors are indicated, whereas the remaining field C indicates the users of the system to which the transponder units are distributed in order to be installed in the respective vehicle.

The field AZ, indicating the operator of the system, i.e. the person that possesses a plurality of equipment element placed at road sides for communicating with passing vehicles through the transponder units thereof. Hereby, fees are recorded for the passage which are reported to a paying institution for charging the owners of the transponder units of the passing vehicles, so that fees due can be provided to the operator.

Thus, if manufacturers of physical equipment, "hardware" such as road side equipment, transponder units and for carrying out the method data storage units such as diskettes and computers for processing them, are not considered, the actors of the system are the following:

The system administrator (field AY) which has installed the system, has the exploitation right thereof and which has the responsibility for the operations which are required for installing it and take it into operation.

The operator, which possesses, as has been mentioned, the road side equipment element which is arranged for remote communication with passing vehicle transponder units. The operator is the person which primarily collect the fees by recording according to the remote communication carried out. The operator is associated with some paying system in which the recordings are transferred to money through debiting of fees due on the respective user of the system, thus owners of the vehicle units.

The system distributor, which finally prepares the transponder units for dedicating them to the users which want to use the system. The distributor cooperates with the operator and can be included in the same organization. A delivery of a transponder unit means simultaneously that data thereof have been recorded in the respective road side units within the area of the operator and that an account has been established in the paying institution.

The user is the person which from the distributor has bought a transponder unit which by storing data is associated with the system and thereby can be used for communication with the roadside equipment within the area of the operator. The task of the system administrator is, as has been indicated above, to provide data for creating programs in the roadside equipment in transponder units, which data are to control the communication between the roadside equipment and the transponder units. The requirements are then:

that the road side equipment is given a definite system assignment, in the shape of system data for the operator in question;

that the road side is provided with code keys for a secure, individual identification of the respective transponder unit;

that the road side equipment possesses store data for the owner of each transponder unit that is identifiable by the respective code key, which data can be vehicle class (in the case where the fee is defined according to different vehicle classes), an account for debiting and credit state;

that the road side equipment possibly also has process data for access to data storage fields in the respective transponder units for reading and/or writing data in addition to the individual data mentioned which are stored in the road side equipment for the respective transponder units;

that the road side equipment possesses process data for calculating, recording and reporting collected fees;

that the transponder unit is provided with system data which indicate its assignment in the system of the operator, in the road side equipments of which the system data in question have been stored;

that the transponder units are given identifying data and process data for a secure collection of these data using the code key of the road side equipment; and that in the case where the mentioned additional data are to be stored for reading and/or writing, process data are stored corresponding to those process data which according to the above have been installed in the road side equipment for accessing the fields.

The task of the system administrator is then to create basic data to be stored in the computer of the road side equipment and in the transponder unit respectively. These data are then to be transferred to a plurality of road side equipment elements and a large number of transponder units, so that the communication as described can be carried out. Then, it is known that this data storing operation can be made by the fact that the system administrator has a direct access to the equipment, at least to some portions of the road side equipment and the transponder units, so that this equipment can be delivered to the operator and the distributors respectively in a finally produced state. However, such a method implies large disadvantages by the fact that the end production of the physical equipment mostly must be carried out centrally and the equipment then be transported to the operator and the distributor, respectively. In particular this is disadvantageous in the case where modifications of the systems are made, when the system administrator must again have access to the physical equipment. The same condition is true in the case where the system is to be expanded for more users than what have been intended from the start.

This problem is solved according to the invention by transferring the data from the system administrator to the operator and the distributor respectively by means of data processing and data storage equipment and media which can be made easily available to all parts. The physical communication equipment can in contrast be manufactured in a non-defined shape what can be made in a mass production, and be transferred from the manufacturer to the operator and the distributor respectively in this shape for a local end or concluding production by means of the equipment and media. The manner in which this is made appears from the following:

The data processing equipment which is used according to the invention comprises common computers such as those of the PC type. Such a computer is referenced 2 in the FIGURE and is indicated by the division in fields as owned by the system administrator.

In this computer, on a data storage medium, which preferably is a master diskette 1, the following data are stored, which are indicated by different fields on a diskette 3. In these fields, the fields 4–6 represent data for storing in the road side equipment and the fields 10–13 data for storing in the respective transponder units, whereas the two fields 12–13 represent a large number of separate data for individual transponder units.

By means of these data on one or several diskettes 3 the system administrator can by means of the computer 2 produce diskettes having selected data. Then, a number of diskettes 15 are produced having only data of the fields 4–6 stored thereon. By transferring these data to data storage equipment of the road side equipments they can be arranged to operate in the system. It is indicated that the non-defined diskette for storing was fetched from a supply 16 of mass produced diskettes.

From the same supply diskettes 18–20 can be fetched for end production of the transponder units. It is supposed to be made in two steps, so that from a diskette 18 having fields corresponding to the fields 10 and 11 of the master diskette 3, a lot of transponder units collected from a supply 22 of mass produced, non defined transponder units, are subjected to a data storing operation common to the system. Thereupon, each transponder unit is subjected to a storing operation individual to it, as is indicated in the FIGURE, by the method that in a transponder unit 25 of the first user data is stored corresponding to the field 12 on the master diskette, whereas in a transponder 26 of the second user data is stored corresponding to the field 13. Of course, the described data units to be stored which correspond to the fields need not to be distributed in different diskettes but they can totally or in part be stored in the same diskette provided that they are given an individual address. As has been mentioned, the fields 12–13 represent a large number of individual data dedicated to each individual transponder unit. In the same way the transponder units 25 and 26 represent a large number of such units which are to be used in the system.

For carrying out the different operations, in addition to data equipment of the system administrator, in the FIGURE represented by the computer 2, also data equipment is required at the operator and the distributor for reading and transferring data from the diskettes which have been obtained from the administrator. Such an equipment is supposed to include standard-type computers which can easily be bought at the local market by the respective parts. For transferring data through such a computer to the transponder units special equipment can be required, a modem, between the computer and the transponder units.

The data storage fields shown are intended to represent the following data:

The field 4 comprises system data for the road side equipment, the fields 5 and 6 code key and individual data for different copies of the transponder unit, thus a large number of fields. In addition thereto process data are to be there. As to data for end production of the transponder units, the field 10 is intended to contain data for initiating the transponder units, i.e. for converting them to the state for data storing, the field 11 system data for use within the system according to the field 4 for the road side equipment, the fields 12 and 13 individual data for a large number of transponder units.

The fields 5, 6 and 12, 13 respectively for individual data must not be included on the diskettes 15 and 19, 20 but only certain basic data and process data for adding more data. Then, in the computer equipment of the operator and the distributor or in common the diskettes can be supplemented with information such as account numbers of respective users, paying institution, etc.

The invention thus means that from standard units such as mass produced diskettes and transponder units system data can be composed on one or a plurality of master diskettes, which in turn are used for producing data diskettes having data selected from the master diskette. These diskettes can be sent to the operator and the distributor for end production of the road side equipment and the required number of transponder units for operating within the system. Also, modifications and additions can be carried out in this way. In the technical aspect, there is no obstacle for transferring the data in question by means of remote communication. However, such communication implies that such a leak could exist that the system could be abused. A great advantage of the invention is thus that it provides a method and means for a more physical shape of transferring data where it is more easy to check that no tapping of data has been made than when using remote communication.

The previous description has as an embodiment of the invention been associated with a system for collecting fees in a traffic context. However, it does not preclude that the invention, following claims, can be applied associated with other traffic checks such as access checks of certain areas, checking of goods transports and similar things. The equipment described can also be of different kinds than directly pointed out by the terms used. Thus, the concept of road side equipment can also mean other traffic checking equipment for remote communication and the concept transponder can also mean other data carrying units which are mounted in the vehicles for remote communication, e.g. provided with active communication equipment instead of a passive transponder.

What is claimed is:

1. A method for producing data carrying communication equipment in traffic checking systems, the data carrying equipment comprising a plurality of stationary communication equipment elements for remotely checking passing vehicles equipped with mobile data carrying units for remote communication, the method comprising:

initially producing the data carrying communication equipment and the vehicle units in a serial manufacturing process in a non-defined shape without storing the data required for the communication;

utilizing for the end production including storing the data a production system comprising a plurality of computers for general data processing and individually handleable data storage media associated with the computers;

storing substantially all data required for carrying out communication between the stationary equipment and the vehicle units on the data storage medium with a system administrator by means of computer equipment of the system administrator;

producing additional separate media from the data storage medium, the additional separate media comprising a first type including data required for storing data in a respective stationary equipment and a second type including data required in respective vehicle units, the data comprising data for assignment to a definite checking system for restriction to vehicle units dedicated to the system, data for identifying individual vehicle units that can be communicated in both the stationary equipment elements and in the vehicle units, and recording and processing data for carrying out the remote checking operations or other operations that are to be performed by the remote communication;

sending to a system operator of the stationary equipment elements copies of the first type of separate media containing data for controlling respective stationary equipment elements;

using the first type of separate media for storing these data in the respective stationary equipment;

sending to a system distributor copies of the second type of separate media containing data for controlling respective vehicle units, the system distributor performing distribution of vehicle units; and distributing the second type of separate media to users of the traffic checking system to be utilized in their vehicles for storing data in the vehicle units.

2. The method according to claim 1, wherein the mobile data carrying units comprise transponders.

3. The method according to claim 1, wherein the individually handleable data storage media comprise data diskettes.

4. The method according to claim 1, wherein the additional separate media comprise diskettes.

5. The method according to claim 1, wherein the additional separate media are transferred in their physical shape during their distribution.

6. A device for producing data carrying communication equipment in traffic checking systems, the systems comprising a plurality of stationary communication equipment elements for remote checking of passing vehicles provided with mobile data carrying units for remote communication, the data carrying communication equipment of the stationary equipment and the vehicle units are initially manufactured in series production in non-defined shape without any storing of data required for the communication, the device comprising:

a system administrator;

a plurality of computers for general data processing;

individually handleable data storage media associated with the computers and arranged for storing by means of the computers substantially all data required for carrying out communication between the stationary equipment and the vehicle units;

additional separate storage media produced from the individually handleable data storage media, the additional separate storage media comprising a first type including data required for storing data in respective stationary equipment elements and a second type including data required for storing in respective vehicle units, the data comprising data for assignment to a definite checking system for restriction to vehicle units that are dedicated to the system, data for identifying individual vehicle units that can be communicated in both a stationary equipment and in the vehicle units, and recording and process data for carrying out the checking operations or other operations that are to be performed by means of the remote communication;

a system operator;

a first additional plurality of computers for general data processing and equipped for transferring data from the first type of separate media to respective stationary equipment, the data including data for controlling the stationary equipment elements;

a system distributor for performing distribution of vehicle units; and a second additional plurality of computers for general data processing and equipped for transferring from the second type of separate media to vehicle units, which are to be distributed to users of the traffic checking system to be utilized in the users' vehicles.

7. The device according to claim 6, wherein the mobile data carrying units for remote communication comprise transponders.

8. The device according to claim 6, wherein the individually handleable data storage media comprise data diskettes.

9. The device according to claim 6, wherein the additional separate storage media comprise diskettes.

* * * * *